United States Patent [19]

Hay, II

[11] 4,105,026

[45] Aug. 8, 1978

[54] BOWLESS EYEGLASSES HOLDER

[75] Inventor: Robert A. Hay, II, Midland, Mich.

[73] Assignee: The Dow Chemical Company, Midland, Mich.

[21] Appl. No.: 745,327

[22] Filed: Nov. 26, 1976

[51] Int. Cl.[2] ..... A62B 9/00

[52] U.S. Cl. ..... 128/142.4

[58] Field of Search ..... 128/142.4, 141 R, 141 A, 128/145 A, 146; 2/10, 13, 439, 444, 443; 351/155, 158

[56] References Cited

U.S. PATENT DOCUMENTS

| | | | |
|---|---|---|---|
| 862,795 | 8/1907 | Blackiston | 2/10 R |
| 3,146,295 | 8/1964 | Roland | 128/142.4 |
| 3,556,645 | 4/1968 | Heilman | 2/10 R |
| 3,563,640 | 2/1971 | Wise et al. | 128/141 R |
| 4,023,214 | 5/1977 | Waldherr | 2/444 |

FOREIGN PATENT DOCUMENTS

| | | | |
|---|---|---|---|
| 643,137 | 3/1937 | Fed. Rep. of Germany | 128/142.4 |
| 706,440 | 4/1941 | Fed. Rep. of Germany | 128/141 R |

*Primary Examiner*—Robert W. Michell
*Assistant Examiner*—Henry J. Recla
*Attorney, Agent, or Firm*—G. R. Plotecher

[57] ABSTRACT

Bowless eyeglasses are fixed to a mask, such as a gas mask, by a bowless eyeglasses holder. A preferred holder has a U-shaped configuration formed from a single, generally rod-shaped, resilient, elongated element. The legs of the U are adapted to engage the mask at the inner surface of the mask housing and the base of the U contains a hook-shaped configuration adapted to engaging the bowless eyeglasses.

6 Claims, 6 Drawing Figures

BOWLESS EYEGLASSES HOLDER

This invention relates to eyeglasses. In one aspect, this invention relates to bowless eyeglasses. In another aspect, this invention relates to a holder for fixing bowless eyeglasses to a mask.

Persons requiring prescription eyeglasses are often faced with a dilemma when required to don a mask, particularly a protective mask. They are generally given two choices, neither adequate: abandon their eyeglasses or wear their eyeglasses under the mask. The former, of course, impairs a mask wearer's vision, if not depriving him of same. The latter is generally awkward at best, if not outright impossible for many protective masks. For example, many protective masks are only effective if they form a continuous seal about a mask wearer's face, a seal that cannot be formed over the bows extending from the eyeglasses frame. This dilemma is particularly acute in emergency situations where, for example, an area is permeated with a noxious gas, immediate rescue action is required, and the only party available to supply said rescue action requires prescription eyeglasses. To have any effectiveness, the spectacled person must wear a protective mask over his eyeglasses, but this allows the noxious gas to enter his mask at the mask-bow juncture thus endangering not only the wearer, but the rescue activity as well.

Accordingly, an important object of this invention is to enable a person requiring prescription eyeglasses to wear a mask thereover without either requiring the person to abandon his eyeglasses or interfering with the seal formed between the mask and the person's face.

A further object of this invention is to provide an eyeglasses holder to engage and fix a person's eyeglasses to a mask in a manner such as to enable a wearer of the mask to effectively see simultaneously through the eyeglasses and the mask.

These and other objects of this invention will be apparent during the course of the following description.

A bowless eyeglasses holder is here provided for fixing bowless eyeglasses to a mask having a mask housing, said housing having at least one transparent eye covering. The holder is disposed upon, and preferably within, the mask as either an integral or a resiliently disengagable part thereof. In the former embodiments, the holder is generally the mask having at least one means shaped and positioned to engage bowless eyeglasses in a generally fixed position relative to the mask housing. In the latter embodiment, the holder generally comprises at least one elongated, resilient element having at least one means for engaging bowless eyeglasses in a generally fixed position relative to the element and at least one means for engaging the mask housing in a generally fixed position, relative to the mask housing. In both embodiments, the engaged eyeglasses are generally fixed opposed the transparent eye covering and in such a manner as to enable a wearer of the mask to effectively see simultaneously through the engaged eyeglasses and the transparent eye covering.

This invention not only eliminates the dilemma faced by persons requiring prescription eyeglasses but does so in a facile, efficient manner.

In the accompanying drawings in which like numerals are employed to designate like parts throughout the same:

Figure 1:
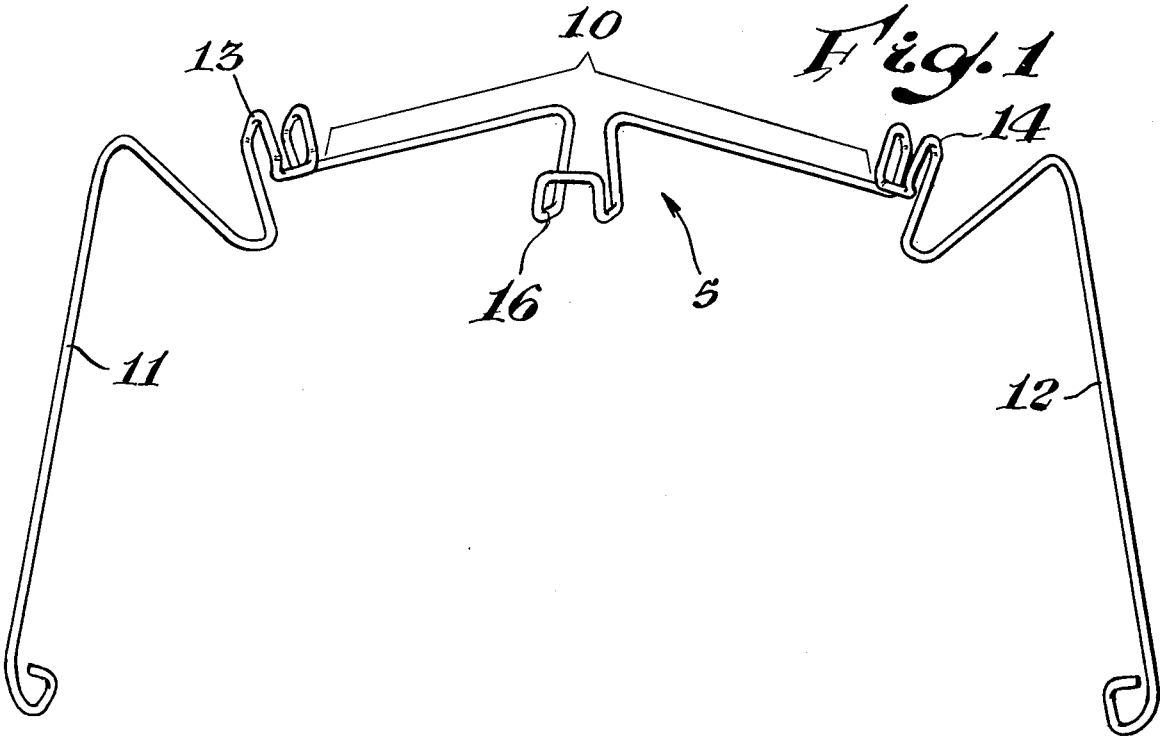
FIG. 1 is an orthographic projection of a preferred, specific embodiment of a resiliently disengagable eyeglasses holder.

In FIG. 1, an eyeglasses holder 5 is shown having a generally planar, U-shaped configuration, a left or first member 11 and a right or second member 12 forming the legs of the U with a bridging member 10 forming the base of the U. The left and right members 11 and 12 and bridging member 10 are equipped with eyeglasses engaging means or hook members 13, 14, and 16, respectively. The means 13, 14 and 16 have a generally hook-shaped configuration when viewed along the axis contained within the plane defined by left member 11 and right member 12 and said means are generally coextensive with one another. Bridging member 10, left and right members 11 and 12, and means 13, 14 and 16 are formed from a single, elongated, resilient, generally rod-shaped element.

Figure 2:
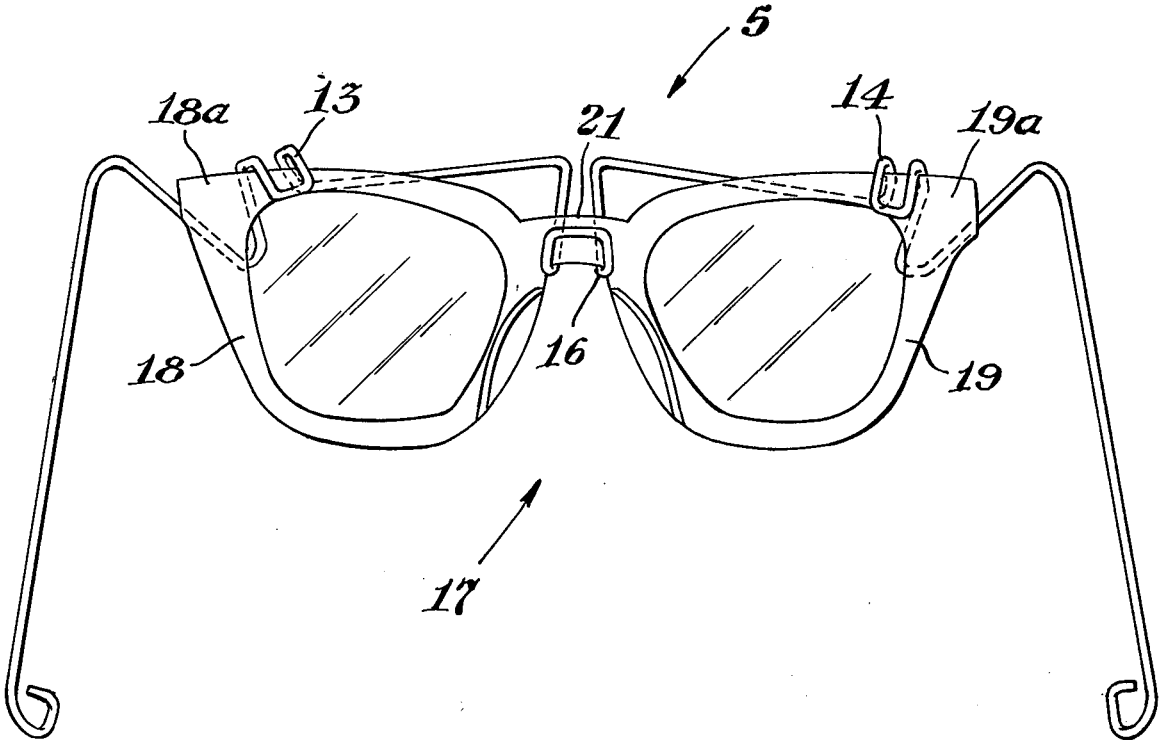
FIG. 2 is a like projection illustrating bowless eyeglasses engaged thereby.

Referring now to FIG. 2, a pair of bowless eyeglasses 17 having a left or first boundary 18 defining a left or first temple connection region **18*a*, a right or second boundary 19 defining a right or second temple connection region 19*a* and a frame bridge 21 are shown supported or engaged by holder 5 of FIG. 1. Means 13 and 14 engage eyeglasses 17 at the left temple connection region 18*a* and at the right temple connection region 19*a*, respectively. Means 16 engages eyeglasses 17 at the frame bridge 21. This illustrated arrangement supports eyeglasses 17 upon the holder 5** in a generally fixed position.

Figure 3:
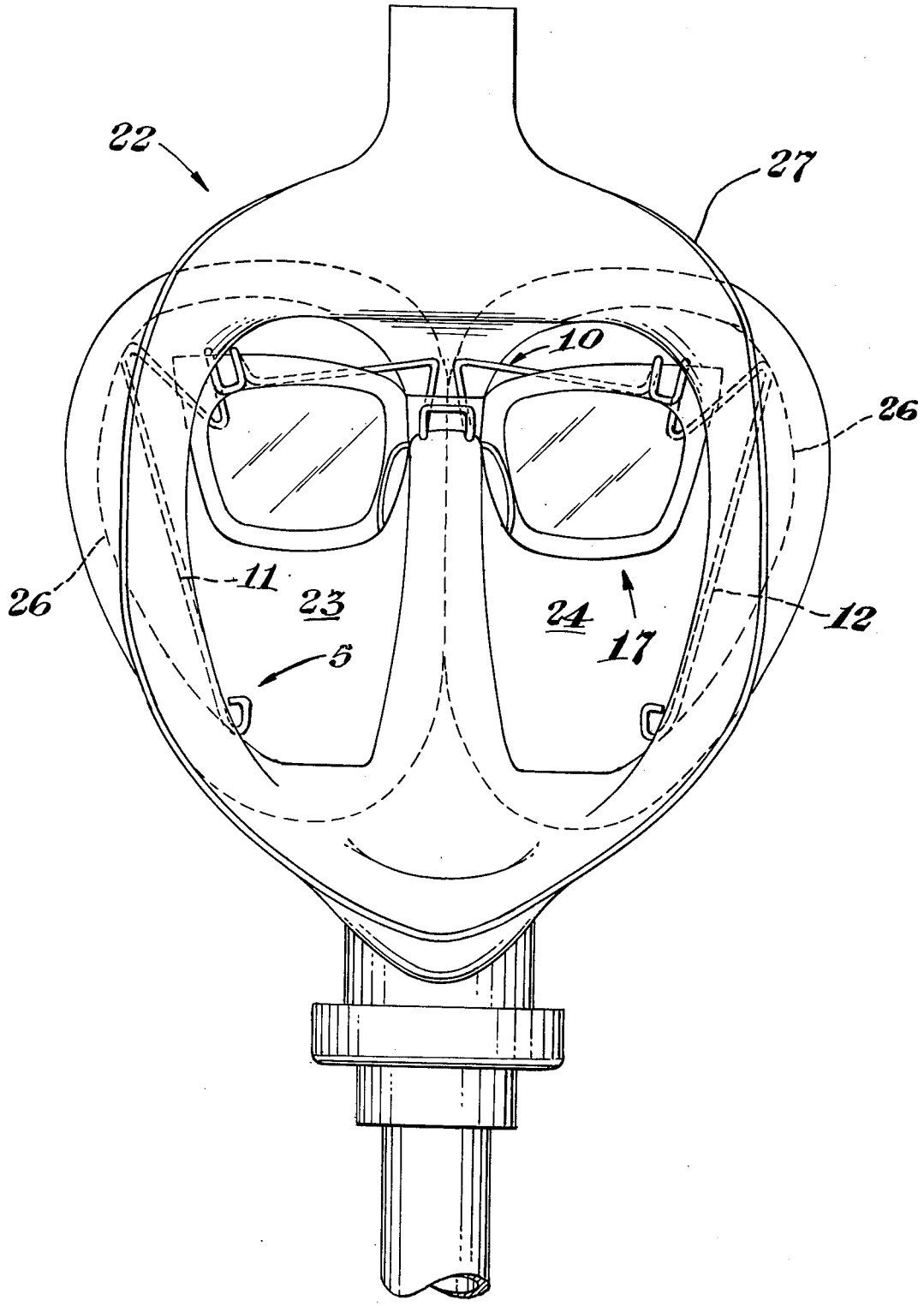
FIG. 3 is a rear elevation of the FIG. 2 eyeglasses holder and engaged eyeglasses fixed within an illustrative protective mask.

Referring now to FIG. 3, a protective mask 22, illustrated here in the form of a gas mask, is shown having disposed therein the supported, bowless eyeglasses 17 of FIG. 2. The mask 22 comprises a mask housing 27, said housing having transparent eye coverings 23 and 24. The supported eyeglasses 17 are positioned within protective mask 22 such that they are opposed transparent eye coverings 23 and 24 in a generally fixed position and in such a manner as to enable a wearer of mask 22 to effectively see simultaneously through the engaged, bowless eyeglasses 17 and the transparent eye coverings 23 and 24. The left and right members 11 and 12 of holder 5 engage an inner surface 26 of the mask housing 27 such that holder 5 is within the mask housing 27 with the bridging member 10 (the base of the U) extending across the top of inner surface 26 and the left and right members 11 and 12 (the legs of the U) extending down the sides of inner surface 26.

Figure 4:
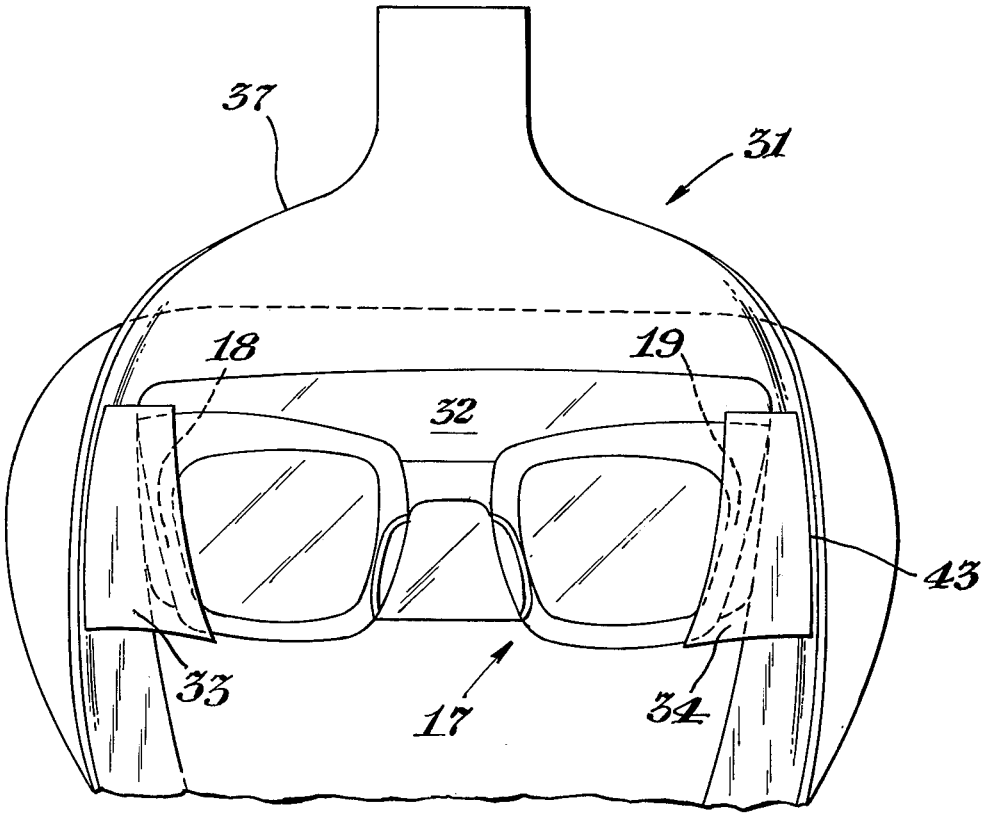
FIG. 4 is a rear elevation of a specific embodiment of bowless eyeglasses engaged by an illustrative protective mask having integrally disposed means for engaging bowless eyeglasses.

Referring now to FIG. 4, the bowless eyeglasses 17 of FIGS. 2 and 3 are shown engaged within a protective mask 31, also illustrated in the form of a gas mask, having a mask housing 37, said housing having a transparent eye covering 32. Eyeglasses engaging means 33 and 34 are integral, projecting, flattened tubular-shaped pockets of protective mask 31 positioned on the left and right sides of an inner surface 43 of the mask housing 37. Said means engage or support bowless eyeglasses 17 in a generally fixed position relative to mask housing 37, opposed transparent eye covering 32, and in such a manner as to enable a wearer of mask 31 to effectively see simultaneously through engaged, bowless eyeglasses 17 and transparent eye covering 32. The means (pockets) 33 and 34 engage the left boundary 18 and the right boundary 19, respectively, when the bowless eyeglasses are inserted into the pockets.

Since the supported eyeglasses are bowless, the seal formed about a mask wearer's face by the mask (housing) is not interrupted by the eyeglasses bows. When a protective mask is required, a prospective wearer need only break or otherwise detach the bows from his eyeglasses, engage his eyeglasses with the means for engaging the bowless eyeglasses, and, if a resiliently disengagable holder is employed, either insert the eyeglasses holder with supported bowless eyeglasses thereon within the protective mask (typically by deflecting the left and right members toward each other), or by engaging the supported eyeglasses to the outside of the mask (typically by clipping same thereto). Of course, the mode of engaging the mask is dependent upon the specific holder embodiment employed.

Although the disengagable eyeglasses holder preferably has a generally U-shaped configuration, other configurations can also be used. For example, a generally O-shaped configuration, formed by the union of the left and right members with both the bridging member and themselves, can be suitable, particularly in scuba-type masks.

If the disengagable holder is intended to engage the inside of the mask, as illustrated in FIG. 3, and a preferred embodiment, then the mask engaging means are generally the left and right members of the holder. These need not be formed from the single, elongated, resilient element that also forms the bridging member, but can be separate structures, rigidly attached to the bridging member by any suitable means, such as welds, clamps, rivets, and the like. Likewise, if the left and right members are joined together to form a generally O-shaped configuration, as stated above, it can be as either one continuous structure or as a plurality of separate structures coupled by any suitable fastener.

If the disengagable holder is intended to engage the outside of the mask, then the means for engaging the mask are generally clamps, clips, pressure-sensitive adhesive-fabric combinations, such as that sold under the designation Velcro$^R$, manufactured by American Velcro, Inc., pressure-sensitive tape, etc. Like the left and right members, these means can be either a continuous extension of the elongated, resilient element or separate structures and rigidly attached to the element (in the form of a member) by any suitable means.

The means for engaging the bowless eyeglasses in the preferred illustrated embodiment of FIG. 1 are hook-shaped contours formed from the single, elongated, resilient generally rod-shaped element that forms both the left and right members and the bridging member. One such means can be sufficient, but generally a plurality are employed for better fixing the eyeglasses to the element. Said means can be disposed at any convenient point(s) on the left and right members and/or bridging member, but are preferably disposed as illustrated in FIGS. 1–3, i.e., adjacent the respective right and left ends of the bridging member and at about the center of the bridging member. Moreover, like the means for engaging the mask, the means for engaging the bowless eyeglasses need not be formed from the single, elongated generally rod-shaped element, but may also be separate structures and rigidly attached to either or both left and right members and/or bridging member by such suitable means as welds, rivets, etc. Also like the means for engaging the mask, these means include pressure-sensitive adhesive-fabric combinations, pressure-sensitive tape, and the like.

The disengagable holder can be constructed of any suitable, resilient material, but spring steel, that similar to music wire, is preferred. Other such suitable materials include metals, such as aluminum, non-sparking beryllium-copper alloy, and the like and plastics, such as urethanes, polyesters, etc.

The means for engaging bowless eyeglasses of the integral holder, as illustrated in FIG. 4, can be shaped and positioned in any suitable manner. A plurality of the means are generally employed for reasons of fastness, assuring support of the eyeglasses in the desired location, but one such means is also suitable. For reasons of efficiency, the means are preferably disposed upon the inner surface of the mask housing and so positioned as to fix the bowless eyeglasses as substantially near a mask wearer's eyes as if the wearer wore the eyeglasses by means of eyeglasses bows. Shape of the means is not critical but is generally such that bowless eyeglasses can be readily received and held (engaged or supported) without interfering with the mask wearer's ability to effectively see simultaneously through both the eyeglasses and the transparent eye covering. Of course, this suggests that the means usually engage the frame of the eyeglasses. The means can have the form of the flattened, tubular-shaped pockets shown in FIG. 4 or can have the form of grooves, folds, contours, and the like. Flexible rubber or like material generally comprise these means and, since they are typically formed as an integral part of the inner surface of the mask housing, they are typically comprised of the same material that comprises said inner surface. However, these means can be fused, adhered, or otherwise integrally attached to the mask and therefore can be comprised of material other than that comprising the inner (or outer) surface of the mask housing.

The masks here used are typically protective masks having housings that form a seal about a mask wearer's face, such as gas masks, as illustrated in FIG. 3, and scuba-type masks. However, this invention is generally adaptable to any mask comprising at least one transparent eye covering and a housing, such as a welding mask and the like. Similarly, any eyeglasses can here be used.

It is to be understood that the forms of this invention, herewith shown and described, are to be taken as preferred examples of the same, and that various changes of the shape, size and arrangement of parts can be resorted to, without departing from the spirit of the invention or the scope of the adjoining claims.

What is claimed is:

1. A resiliently disengagable bowless eyeglasses holder for fixing bowless eyeglasses to a mask having a mask housing, said housing having at least one transparent eye covering and inner surface means extending around the periphery of the transparent eye covering, the holder comprising at lest one elongated, resilient element having:

(a) left, right and bridging members wherein the right and left members are connected by the bridging member member form a generally planar, U-shaped configuration, the right and left members forming the legs of the U and the bridging members forming the base of the U, said bridge member and said left and right members including generally hook-shaped means for engaging the bowless eyeglasses, the left and right members having said hook shaped means for engaging the top portions of the bowless eyeglasses frame at the temple connections and the center portion of said bridging member of said holder having said hook-shaped means for engaging under the bridging member of the bowless eyeglasses frame, the hook-shaped configurations of the left and right members located adjacent the respective left and right ends of the bridging member and the hook-shaped configuration of the bridging member located at about the center thereof, and (b) the left and right members of the holder being resilient and including end portions adapted for engaging the mask at the inner surface means of the mask housing such that the holder is within the mask housing with the base of the U extending adjacent the top of the inner surface means of the mask housing and the legs of the U extending adjacent the sides of the inner surface means of the mask housing with said end portions of said left and right members engaging said inner surface means such that the holder engages the mask in a generally fixed position and in such a manner that the engaged eyeglasses are opposed the transparent eye covering and that a wearer of the mask can effectively see simultaneously through the engaged bowless eyeglasses and the transparent eye covering.

2. The holder of claim 1 wherein the elongated, resilient element is generally rod-shaped.

3. The holder of claim 2 wherein the holder is constructed of spring steel.

4. A protective mask for protecting the face of an eyeglasses wearer while enabling the wearer to effectively see through the eyeglasses comprising, in combination:

(a) a mask comprising a housing, said housing having at least one transparent eye covering and inner surface means extending around the periphery of said transparent eye covering, (b) a resiliently disengagable bowless eyeglasses holder for fixing bowless eyeglasses to said mask housing, the holder comprising at least one elongated, resilient element having:

(i) left, right and bridging members wherein the right and left members are connected by the bridging member to form a generally planar, U-shaped configuration, the right and left members forming the legs of the U and the bridging member forming the base of the U, said bridging member and said left and right members including generally hook-shaped means for engaging the bowless eyeglasses, the left and right members having said hook shaped means for engaging the top portions of the bowless eyeglasses frame at the temple connections and the center portion of said bridging member of said holder having said hook-shaped means for engaging under the bridging member of the bowless eyeglasses frame, the hook-shaped means of the left and right members located adjacent the respective left and right ends of the bridging member and the hook-shaped means of the bridging member located at about the center thereof, and (ii) the left and right members of the holder being resilient and including end portions adapted for engaging the mask at said inner surface means of the mask housing such that the holder is within the mask housing with base of the U extending adjacent the tops of the inner surface means of the mask housing and the legs of the U extending adjacent the sides of the inner surface means of the mask housing with said end portions of said left and right members engaging said inner surface means such that the holder engages the mask in a generally fixed position and in such a manner that the engaged eyeglasses are opposed the transparent eye covering and that a wearer of the mask can effectively see simultaneously through the engaged bowless eyeglasses and the transparent covering, and (c) bowless eyeglasses supported by the hook-shaped means of the holder in a generally fixed position and opposed the transparent eye covering of the mask housing.

5. The protective mask of claim 4 wherein the mask is a gas mask.

6. The protective mask of claim 5 wherein the holder is constructed of spring steel.

* * * * *